US005706845A

United States Patent [19]

Beyar et al.

[11] Patent Number: 5,706,845

[45] Date of Patent: Jan. 13, 1998

[54] WALKER ADAPTER

[76] Inventors: George Beyar; Joanne Morello, both of 475 Armstrong Ave. #D2, Staten Island, N.Y. 10308

[21] Appl. No.: 801,045

[22] Filed: Feb. 14, 1997

[51] Int. Cl.[6] ..... A61H 3/00

[52] U.S. Cl. ..... 135/67; 135/65; 135/66; 248/631

[58] Field of Search ..... 135/65, 66, 67; 248/631

[56] References Cited

U.S. PATENT DOCUMENTS

| | | | |
|---|---|---|---|
| 1,223,707 | 4/1917 | Lyon . | |
| 1,404,572 | 1/1922 | Bowman . | |
| 1,530,405 | 3/1925 | Perrine . | |
| 1,688,922 | 10/1928 | Drinosky . | |
| 3,787,019 | 1/1974 | Freitag | 248/631 X |
| 4,621,804 | 11/1986 | Mueller . | |
| 4,861,051 | 8/1989 | Napper | 135/67 X |
| 4,987,912 | 1/1991 | Taylor | 135/67 |
| 5,224,721 | 7/1993 | Santman | 135/67 X |
| 5,241,876 | 9/1993 | Mathis | 135/66 X |
| 5,255,697 | 10/1993 | Grauer . | |
| 5,271,422 | 12/1993 | Sorrell et al. | 135/66 |
| 5,427,438 | 6/1995 | Fochs | 135/67 X |
| 5,449,013 | 9/1995 | Landers | 135/67 |
| 5,467,793 | 11/1995 | Hart | 135/67 |
| 5,476,432 | 12/1995 | Dickens | 135/67 X |

*Primary Examiner*—Wynn E. Wood
*Attorney, Agent, or Firm*—Goldstein & Associates

[57] ABSTRACT

A walker adapter used to prevent an individual's legs from crossing while using a walker to enhance ambulatory skills, the walker adapter comprising an adjustable main member having opposite ends, a posterior attachment mechanism secured at a right angle to one end of the adjustable main member, and an anterior attachment assembly secured at the opposite end thereof. A posterior clamp secured to the posterior attachment is affixed to a rear cross brace of the walker, and anterior clamps which are secured to the anterior attachment assembly are affixed to front vertical members of the walker, so that the walker adapter extends between the legs of the individual and prevents the individual's legs from crossing while walking with the walker.

6 Claims, 4 Drawing Sheets

WALKER ADAPTER

BACKGROUND OF THE INVENTION

The invention relates to a walker adapter. More particularly, the invention relates to a walker adapter which attaches to the structural members of a walker, thus aiding a user in walking without crossing his/her legs.

Walkers have been utilized for many years by people of all ages who undergo rehabilitation or attend therapy sessions. Typical rehabilitative walkers comprise a metal frame with an open front portion, rearwardly-extending side portions forming hand grips at a convenient height for the person using the walker and a back portion. Usually the frame has four legs extending from it. A user would stand so that the frame of the walker is positioned around him/her.

In use, the user moves ahead by taking a step or two and then picking up the walker, or sliding it along the floor, and moving it back into position around the user. However, such walkers are not capable of use by more seriously handicapped persons who require more support and guidance. Handicapped children in particular have a tendency to cross their legs when employing a walker.

U.S. Pat. No. 4,621,804 to Mueller discloses a therapeutic roller/walker comprising a walker frame and an elongated crotch-cradling panel of flexible material. The panel serves as an added support for persons using the walker. However, this added support will tend to hinder the user's progress since the support limits the amount of work the user need to exert.

While these units may be suitable for the particular purpose employed, or for general use, they would not be as suitable for the purposes of the present invention as disclosed hereafter.

SUMMARY OF THE INVENTION

It is an object of the invention to produce a walker adapter which attaches to the structural members of a walker thus aiding a user in keeping his/her legs straight when learning how to walk.

It is another object of the invention to produce a walker adapter that can be easily and quickly attached to and used with a wide variety of walkers.

It is a further object of the invention to produce a walker adapter that aids in keeping the user's legs from crossing when attending rehabilitation or therapy sessions.

The invention is a walker adapter used to prevent an individual's legs from crossing while using a walker to enhance ambulatory skills, the walker adapter comprising an adjustable main member having opposite ends, a posterior attachment mechanism secured at a right angle to one end of the adjustable main member, and an anterior attachment assembly secured at the opposite end thereof. A posterior clamp secured to the posterior attachment is affixed to a rear cross brace of the walker, and anterior clamps which are secured to the anterior attachment assembly are affixed to front vertical members of the walker, so that the walker adapter extends between the legs of the individual and prevents the individual's legs from crossing while walking with the walker. To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
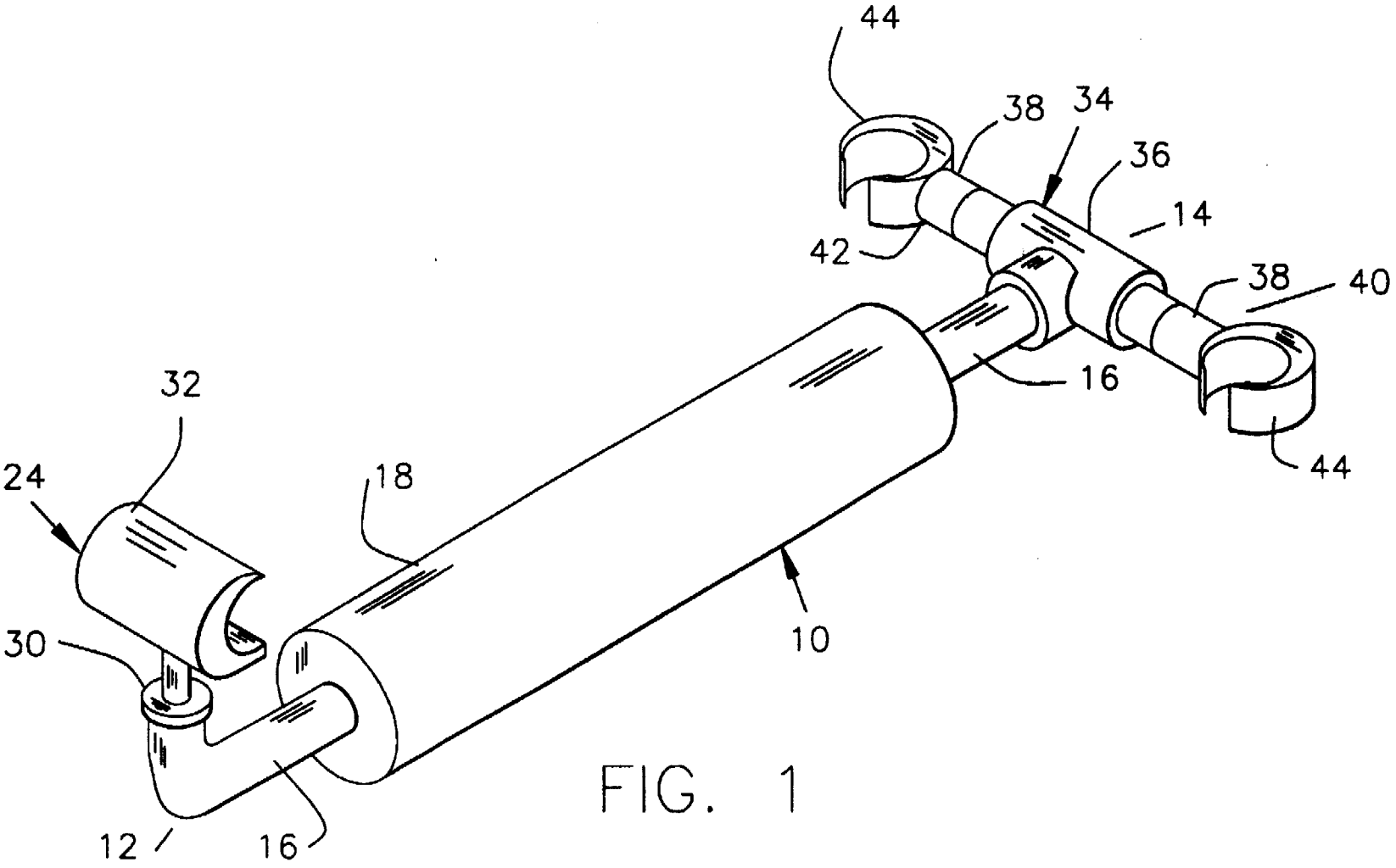
FIG. 1 is a diagrammatic perspective view of the walker attachment.

FIG. 1 illustrates a walker adapter 10 comprising an anterior end 14 and a posterior end 12 located opposite therefrom. The walker adapter 10 further comprises an adjustable main member 16 having opposite ends, which extends from the anterior end 14 to the posterior end 12. A cushion 18 encircles the majority of the length of the adjustable main member 16, so as to soften any contact between a user and the adjustable main member 16. In an alternate embodiment, the cushion 18 may be split along its length and removable so as to facilitate cleaning.

Figure 2:
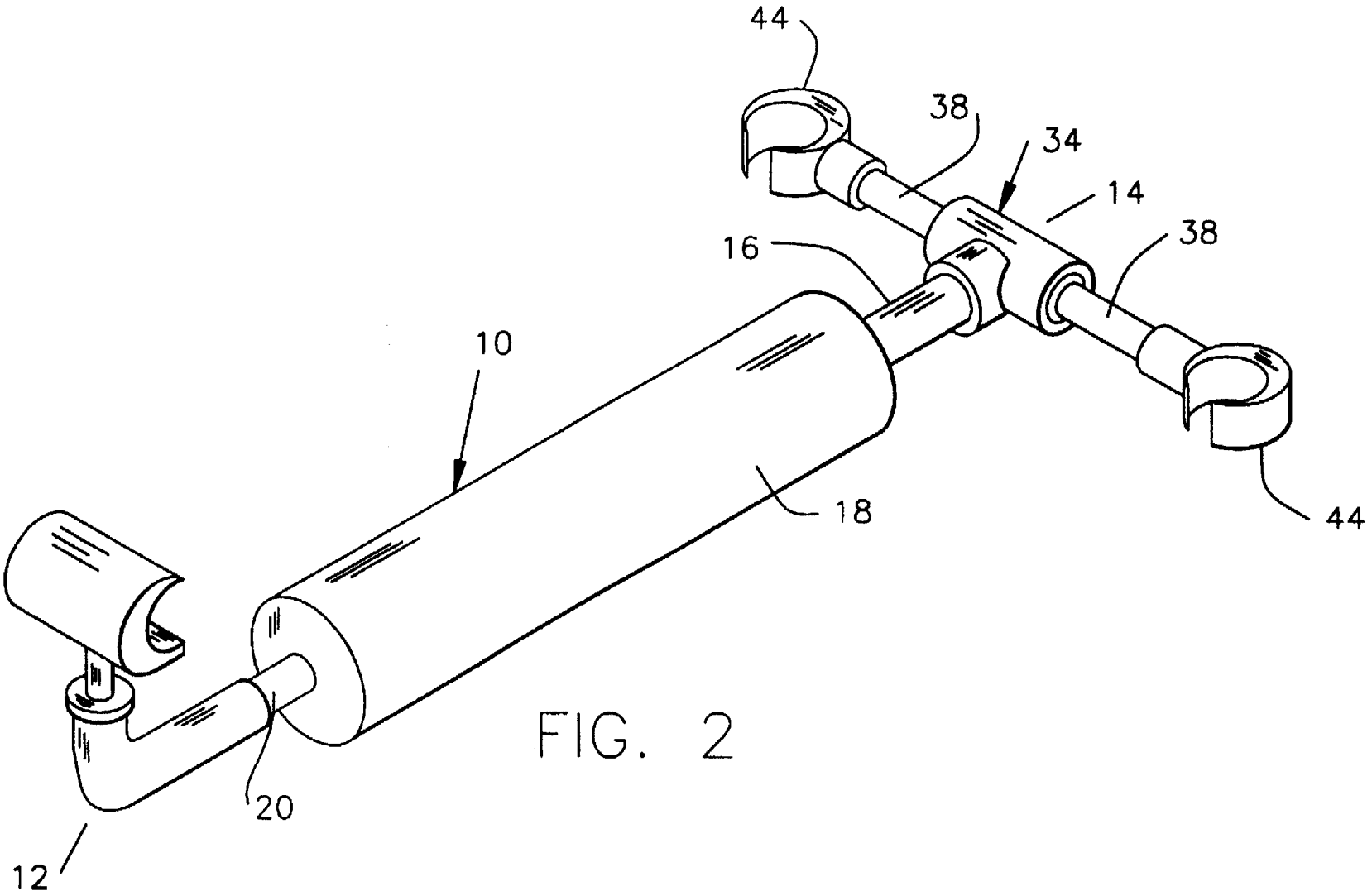
FIG. 2 is a diagrammatic perspective view of the walker attachment illustrated in an extended position.
Figure 5:
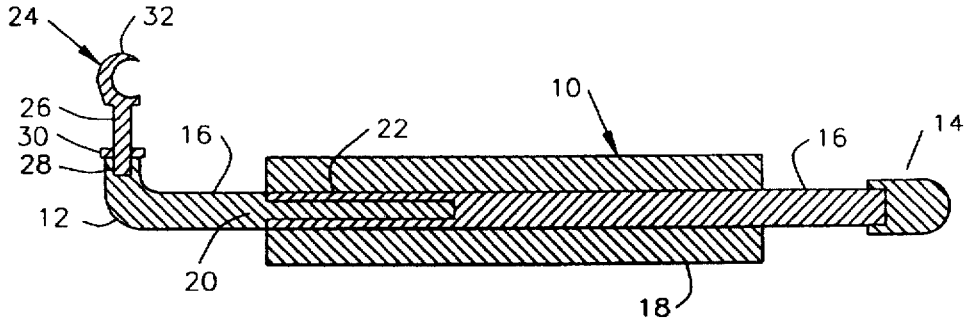
FIG. 5 is a cross sectional view of the walker attachment taken along line 2—2 of FIG. 4.

Reference to FIG. 5 depicts a cross-sectional view of the walker adapter 10, and illustrates more specifically the adjustable feature of the adjustable main member 16. It can be seen there that the adjustable main member 16 further comprises a piston portion 20 and a cylinder portion 22. The piston portion 20 of the adjustable main member 16 is slidably contained within the cylinder portion 22 thereof, thus allowing the overall length of the adjustable main member 16 to be varied, as can be seen by contrasting FIG. 1 with FIG. 2. In FIG. 2, the extended adjustable main member 16 is shown, with a section of the piston portion 20 exposed.

Figure 3:
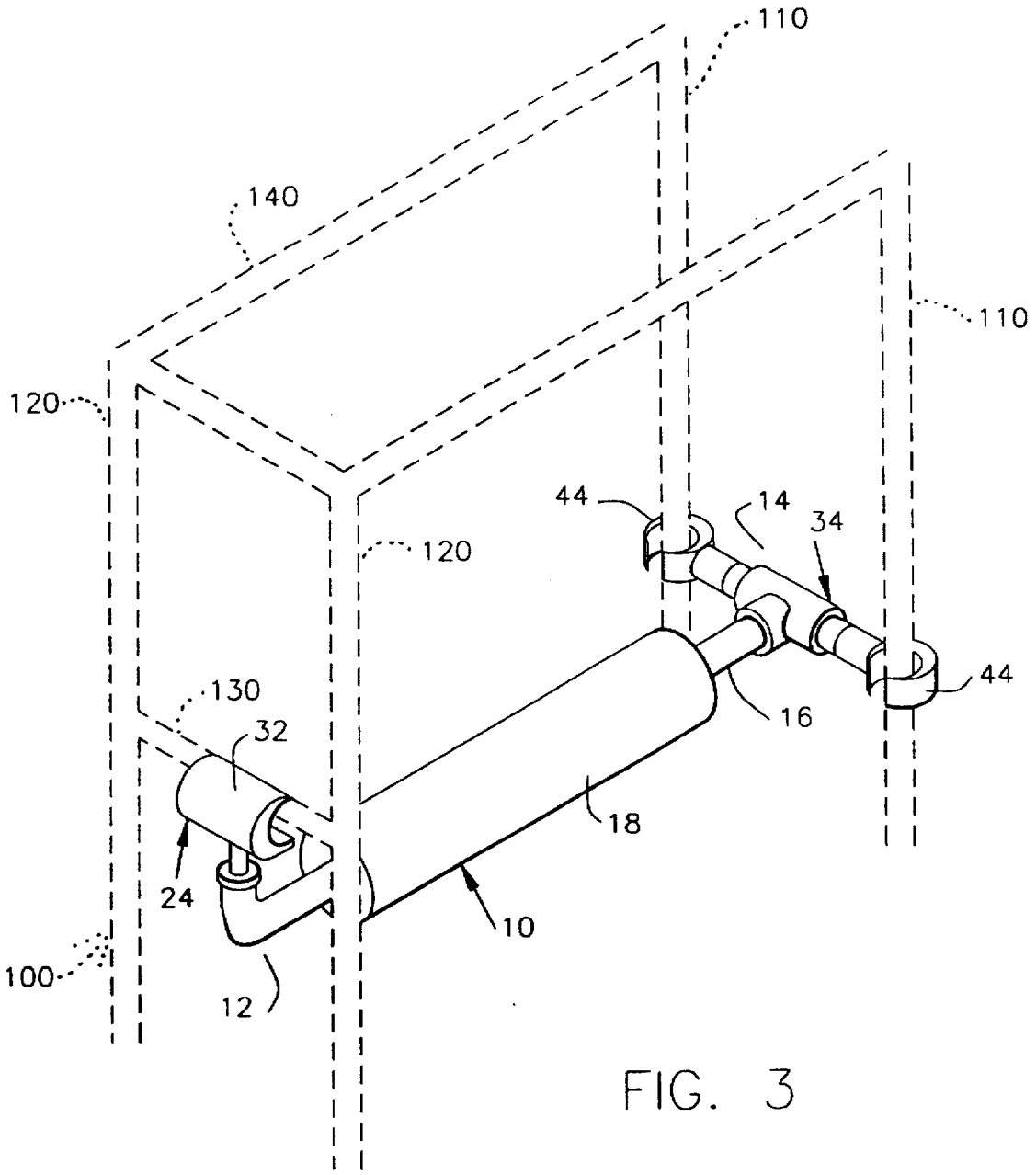
FIG. 3 is a diagrammatic perspective view of the walker attachment attached to a walker.

Referring back to FIG. 1, it can also be seen that the walker adapter 10 further comprises a posterior attachment mechanism 24 for securing the posterior end 12 of the walker adapter 10 to a walker 100 as can be seen in FIG. 3 and will be discussed in further detail later. As seen in FIG. 5, the posterior attachment mechanism 24 is secured to the adjustable main member 16 of the walker adapter 10 at a right angle, and comprises a posterior attachment neck 26 which is slidably contained within a posterior cylinder 28 of the adjustable main member 16, thus allowing the height of said posterior attachment mechanism 24 to be varied as needed. A threaded collar 30 affixed to upturned portion of the adjustable main member 16 permits the adjusted height of the posterior attachment mechanism 24 to be permanently maintained by tightening said threaded collar 30 about the adjustable main member 16. The posterior attachment mechanism 24 also comprises a posterior clamp 32 attached to the posterior attachment neck 26, said posterior clamp 32 consisting of a semi-circle which is sized smaller than the structural members of the walker 100 to which it is to be attached, so that said posterior clamp 32 may be attached thereto by applying a slight amount of pressure, as can be seen in FIG. 3.

Figure 4:
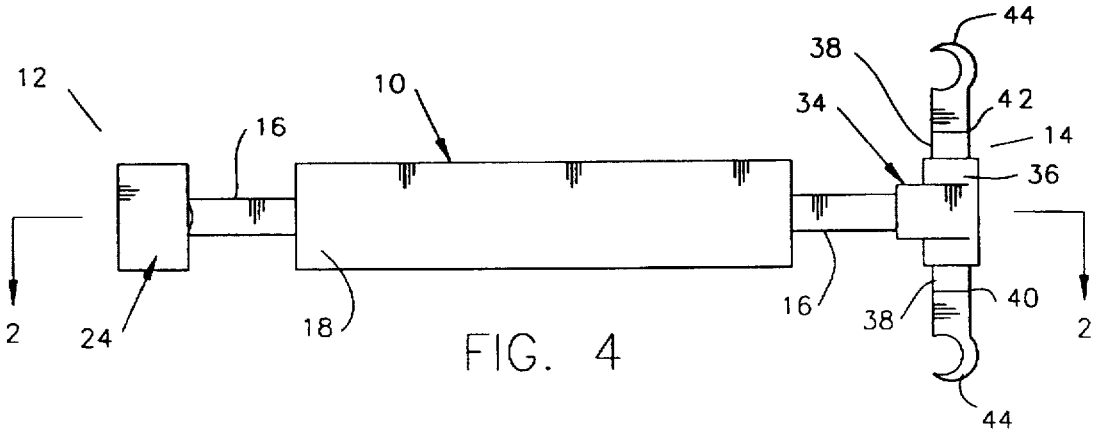
FIG. 4 is a top plan view of the instant invention.

An anterior attachment assembly 34 is located at the anterior end 14 of the walker adapter 10, and will be discussed in detail in reference to FIGS. 1, 2 and 4. The anterior attachment assembly 34 comprises a T-shaped connector 36 which is secured to the end of the adjustable main member 16. An assembly pin 38 extends through said T-shaped connector 36, perpendicular to the adjustable main member 16, and comprises opposite pin ends 40 and 42. An anterior clamp 44 is secured to each pin end 40 and 42 of the assembly pin 38. Said anterior clamps 44 are similar to the posterior clamp 32 discussed earlier in that each clamp 44 consists of a semi-circle which is sized smaller than the structural members of the walker 100, so that said anterior clamp 44 may be attached thereto by applying a slight amount of pressure, as depicted in FIG. 3.

The overall length of said assembly pin 38 can be varied, as can be seen by contrasting FIG. 1 with FIG. 2. Accordingly, the distance between the anterior clamps 44 can be varied to allow the walker adapter 10 to be utilized upon a variety of sized walkers 100.

FIG. 3 illustrates a typical walker 100 which the instant invention is intended to be installed upon. As shown, the walker 100 consists of a plurality of front vertical members 110, rear vertical members 120, a rear cross-brace 130, and horizontal members 140 which extend parallel to each other and are secured between the front vertical members 110 and rear vertical members 120, said horizontal members 140 functioning as hand-rails for the individual using the walker 100.

Typically, an individual undergoing rehabilitation or otherwise learning how to walk properly enters the walker 100 between the front vertical members 110 and the individual is positioned between the horizontal members 140. While using said horizontal members 140 for support by grasping them firmly, the individual then attempts to take a few steps. After successfully completing a few steps, the individual then drags the walker 100 a small distance, such that the individual is again contained between the horizontal members 140. A problem which often presents itself is that the individual's legs "scissors" or cross, and fail to adequately support the individual upright. Once installed, the instant invention eradicates this problem.

The walker adapter 10 is installed upon the walker by aligning each of the anterior clamps 44 with each of the front vertical members 110 and then pressing each of said anterior clamps 44 firmly against each of said vertical members 110 respectively until they are affixed thereto, as seen in FIG. 3. The length of the adjustable main member 16 is then adjusted, as is the height of the posterior attachment mechanism 24, so that the posterior clamp 32 is aligned with the rear cross brace 130. The posterior clamp 32 is then pressed firmly and affixed to said rear cross-brace 130. The individual to use the walker 100 with the walker adapter 10 installed then enters the interior of the walker 100 between the front vertical members 110 as discussed earlier, and places a leg on one side of the walker adapter 10 and the other leg on the opposite side, so that the individual may then proceed to take a few steps without the concern that his or her legs will "scissors" or cross.

What is claimed is:

1. A walker adapter for securing to a walker, the walker comprising a plurality of front vertical members, rear vertical members, rear cross-brace and horizontal members, the walker adapter having an anterior end and a posterior end located opposite therefrom, comprising:

an adjustable main member having opposite ends, which extends from the anterior end to the posterior end of the walker adapter;

a posterior attachment mechanism, secured at a right angle to the adjustable main member, for securing the posterior end of the walker adapter to the rear cross brace of the walker; and an anterior attachment assembly, secured at the anterior end of the walker adapter to the adjustable main member, for securing the anterior end of the walker adapter to the front vertical members; wherein the walker adapter may be secured to the walker and a user permitted to use the walker without the user's legs crossing while taking progressive steps.

2. The walker adapter of claim 1, wherein the adjustable main member further comprises a piston portion and a cylinder portion, the piston portion slidably mounted within the cylinder portion, thus allowing the overall length of the adjustable main member to be varied to accommodate installing the walker adapter upon various sized walkers.

3. The walker adapter of claim 2, wherein the posterior attachment mechanism comprises:

a posterior attachment neck and a posterior cylinder, the posterior attachment neck slideably contained within the posterior cylinder; and a posterior clamp, attached to the posterior attachment neck, semi-circle in shape and sized smaller than the rear cross-brace of the walker to which it attaches so that it may be secured firmly thereto upon application of pressure, wherein the slideably contained posterior attachment neck permits the height of the posterior clamp to be varied according to the height of the rear cross-brace.

4. The walker adapter of claim 3, wherein the anterior attachment assembly comprises:

a T-shaped connector, secured at the anterior end of the walker adapter to an end of the adjustable main member;

an assembly pin, variable in length, extending through said T-shaped connector perpendicular to the adjustable main member, and further comprising opposite pin ends; and a plurality of anterior clamps, each secured to one of the pin ends of the assembly pins, semi-circle in shape and sized smaller than the front vertical members of the walker to which it attaches so that it may be secured firmly thereto upon application of pressure, wherein the variable length assembly pin permits the distance between the anterior clamps to be varied so that the walker adapter may be installed upon walkers of various sizes.

5. The walker adapter of claim 4, wherein a cushion encircles the majority of the length of the adjustable main member, so as to soften any contact between a user and the adjustable main member.

6. A method of using a walker adapter to prevent an individual's legs from crossing while using a walker to enhance ambulatory skills, the walker adapter comprising an adjustable main member having opposite ends, a posterior attachment mechanism secured at a right angle to one end of the adjustable main member and an anterior attachment assembly secured at the opposite end thereof, comprising the steps of:

1)adjusting the length of the adjustable main member so that the posterior attachment mechanism is aligned with a rear cross brace of the walker, and securing said posterior attachment mechanism thereto;

2) adjusting the length of the adjustable main member so that the anterior attachment assembly is aligned with a pair of front vertical members of the walker, and securing anterior clamps which are affixed to the anterior attachment assembly to said front vertical members;

3) an individual entering the walker, positioned such that one of said individual's legs is located on side of the adjustable main member of the walker adapter, and the individual's other leg located on the opposite side therefrom, so that said legs are not permitted to cross; and 4) the individual proceeding to walk forward.

* * * * *